US006520440B2

(12) United States Patent
Ragnarsson

(10) Patent No.: US 6,520,440 B2
(45) **Date of Patent: *Feb. 18, 2003**

(54) ARRANGEMENT FACILITATING SINGLE FASTENER ATTACHMENT FOR STRIKERS OF A WOOD COMMINUTING ROTOR

(76) Inventor: Anders T. Ragnarsson, 236 Haverhill Rd., Chester, NH (US) 03036

( * ) Notice: Subject to any disclaimer, the term of this patent is extended or adjusted under 35 U.S.C. 154(b) by 0 days.

This patent is subject to a terminal disclaimer.

(21) Appl. No.: 09/885,635

(22) Filed: Jun. 20, 2001

(65) Prior Publication Data

US 2002/0017580 A1 Feb. 14, 2002

Related U.S. Application Data

(63) Continuation-in-part of application No. 09/635,320, filed on Aug. 9, 2000, now Pat. No. 6,394,378.

(51) Int. Cl.[7] ..... B02C 13/28
(52) U.S. Cl. ..... 241/294

(58) Field of Search ..... 241/189.1, 191, 241/197, 294, 295

(56) References Cited

U.S. PATENT DOCUMENTS

| | | | | |
|---|---|---|---|---|
| 5,165,611 A | | 11/1992 | Ragnarsson | |
| 6,045,072 A | * | 4/2000 | Zehr | 241/189.1 |
| 6,131,838 A | * | 10/2000 | Balvanz et al. | 241/195 |
| 6,394,378 B1 | * | 5/2002 | Ragnarsson | 241/294 |

* cited by examiner

*Primary Examiner*—John M. Husar
(74) *Attorney, Agent, or Firm*—Davis & Bujold, P.L.L.C.

(57) ABSTRACT

A comminuting striker assembly for mounting on a rotor of a comminuting apparatus comprising: a striker having first and second opposed faces, the first face defining at least one cutting edge, and the second face defining a pair of perpendicular slots; a striker retainer having a leading face for attachment to the striker, the leading face defining a pair of perpendicular keys to be received by the slots; and a single threaded fastener for joining the striker to the striker retainer.

12 Claims, 9 Drawing Sheets

ARRANGEMENT FACILITATING SINGLE FASTENER ATTACHMENT FOR STRIKERS OF A WOOD COMMINUTING ROTOR

RELATED APPLICATION

This is a continuation-in-part of patent application Ser. No. 09/635,320 filed Aug. 9, 2000 now U.S. Pat. No. 6,394,378.

FIELD OF THE INVENTION

The invention provides an improved striker attachment for wood comminuting rotors which facilitates a keyed attachment enabling both a single fastener to be utilized attaching the striker to the striker retainer, and rapid removal and replacement of the striker.

BACKGROUND OF THE INVENTION

Prior art comminuting apparatus for reducing large diameterwood products and stumps to a desired size, have comprised a reduction chamber, with an impact rotor positioned concentrically therein, in combination with a housing, drive motor and infeed chute. The impact rotor is formed with a plurality of horizontally elongate impact strikers at its periphery. The rotor is positioned so that the elongate wood product or stump falling under the influence of gravity through the infeed chute is directed against the strikers, and repelled ahead of the rotor's rotational direction against an anvil formed along one side of the reduction chamber.

Prior art wood comminuting apparatus are often capable of comminuting trees or parts thereof up to 40 inches in diameter (see e.g. U.S. Pat. No. 5,165,611). Strikers used for the comminution are bolted directly to mounting projections on the rotor which is rotated to produce the comminution. Maintenance to change strikers has required complete removal of the striker mounting bolts with the consequent potential loss of bolts and uneconomical use of maintenance time, especially in view of the substantial number of strikers on a rotor of such apparatus. Strikers of the prior art are typically fastened with two (2) hex head or similar studs, stud-bolts or bolts, relying on fastener torque to position and retain the strikers, resulting in the above noted potential loss of bolts and uneconomical use of maintenance time.

SUMMARY OF THE INVENTION

It is an object of the invention to improve maintenance time and ease of striker replacement in comminution apparatus minimizing the potential for loss of components including fasteners.

It is a further object of the invention to improve the fixed positioning of the strikers for initial installation of the strikers, during operation of the comminuting device, and during maintenance or replacement of strikers.

According to the invention there is provided a comminuting striker assembly for mounting on a rotor of a comminuting apparatus, comprising: a striker having first and second opposed faces, the first face defining at least one cutting edge, and the second face defining at least one slot; a striker retainer having a leading face for attachment to the striker, said leading face defining at least one raised key, and an opposed following face; a threaded fastener for joining said striker to said striker retainer, whereby the slot of the striker closely mates with the key of the striker retainer.

Also according to the invention there is provided a comminuting striker assembly for mounting on a rotor of a comminuting apparatus, comprising: a striker having first and second opposed faces, the first face defining at least one cutting edge, and the second face defining at least one raised key; a striker retainer having a leading face for attachment to the striker, said leading face defining at least one slot; a threaded fastener for joining said striker to said striker retainer, whereby the key of the striker closely mates with the slot of the striker retainer.

In an alternative embodiment there is provided a comminuting striker assembly for mounting on a rotor of a comminuting apparatus, comprising a striker having first and second opposed faces, the first face defining at least one cutting edge, and the second face defining first and second slots transverse of one other, the first being parallel to the at least one cutting edge; a striker retainer having a leading face for attachment to the striker, said leading face defining first and second raised keys, to be received by said slots; wherein the second raised key closely engages the corresponding slot; and the striker retainer defines a striker support surface engaging a cooperating surface on the striker to provide primary support for the striker by virtue of a cooperating surface on the striker and a clearance between the first slot and the raised key received thereby.

According to the invention there is also provided a method to attach a comminuting striker assembly for mounting on a rotor of a comminuting apparatus, comprising the steps of: providing a striker having first and second opposed faces, the first face defining at least one cutting edge, and the second face defining first and second slots perpendicular to one another; providing a striker retainer having a leading face for attachment to the striker, said leading face defining first and second raised keys to closely engage the slots; providing a bore through the striker retainer for a fastener means; providing a single fastener joining means in the striker; mating the striker slots with the striker retainer raised keys; and installing a single fastening means through the bore and mating with the fastener joining means in the striker for joining said striker to said striker retainer, whereby the slots of the striker closely mate with the keys of the striker retainer.

Also according to the invention there is provided a method to attach a comminuting striker assembly for mounting on a rotor of a comminuting apparatus, comprising the steps of: providing a striker having first and second opposed faces, the first face defining at least one cutting edge, and the second face defining first and second raised keys perpendicular to one another; providing a striker retainer having a leading face for attachment to the striker, said leading face defining first and second slots to closely engage the keys; providing a bore through the striker retainer for a fastener means; providing a single fastener joining means in the striker; mating the striker raised keys with the striker retainer slots; and installing a single fastening means through the bore and mating with the fastener joining means in the striker for joining said striker to said striker retainer, whereby the keys of the striker closely mate with the slots of the striker retainer.

In another embodiment of the invention, there is provided a method to attach a comminuting striker assembly for mounting on a rotor of a comminuting apparatus, comprising the steps of providing a striker having first and second opposed faces, the first face defining at least one cutting edge, and the second face defining first and second slots perpendicular to one another, the first being parallel to the at least one cutting edge; providing a striker retainer having a leading face for attachment to the striker, said leading face defining first and second raised keys to be received in the slot; providing a support surface on the striker retainer, separate from the keys, to engage a cooperating surface provided on the striker to provide primary support for the striker; providing a bore through the striker retainer for a fastener means; providing a single fastener joining means in the striker; mating the striker slots with the striker retainer slot; and installing a single fastening means through the bore and mating with the fastener joining means in the striker for joining said striker to said striker retainer, whereby the second raised key closely mates with the corresponding slot and the cooperating surface on the striker rests on the support surface on the striker retainer to provide primary support for the striker by virtue of a clearance provided between the first slot and the first raised key.

BRIEF DESCRIPTION OF THE DRAWINGS

The invention will now be described, by way of example, with reference to the accompanying drawings, in which.

DETAILED DESCRIPTION OF THE EMBODIMENTS

Figure 1:
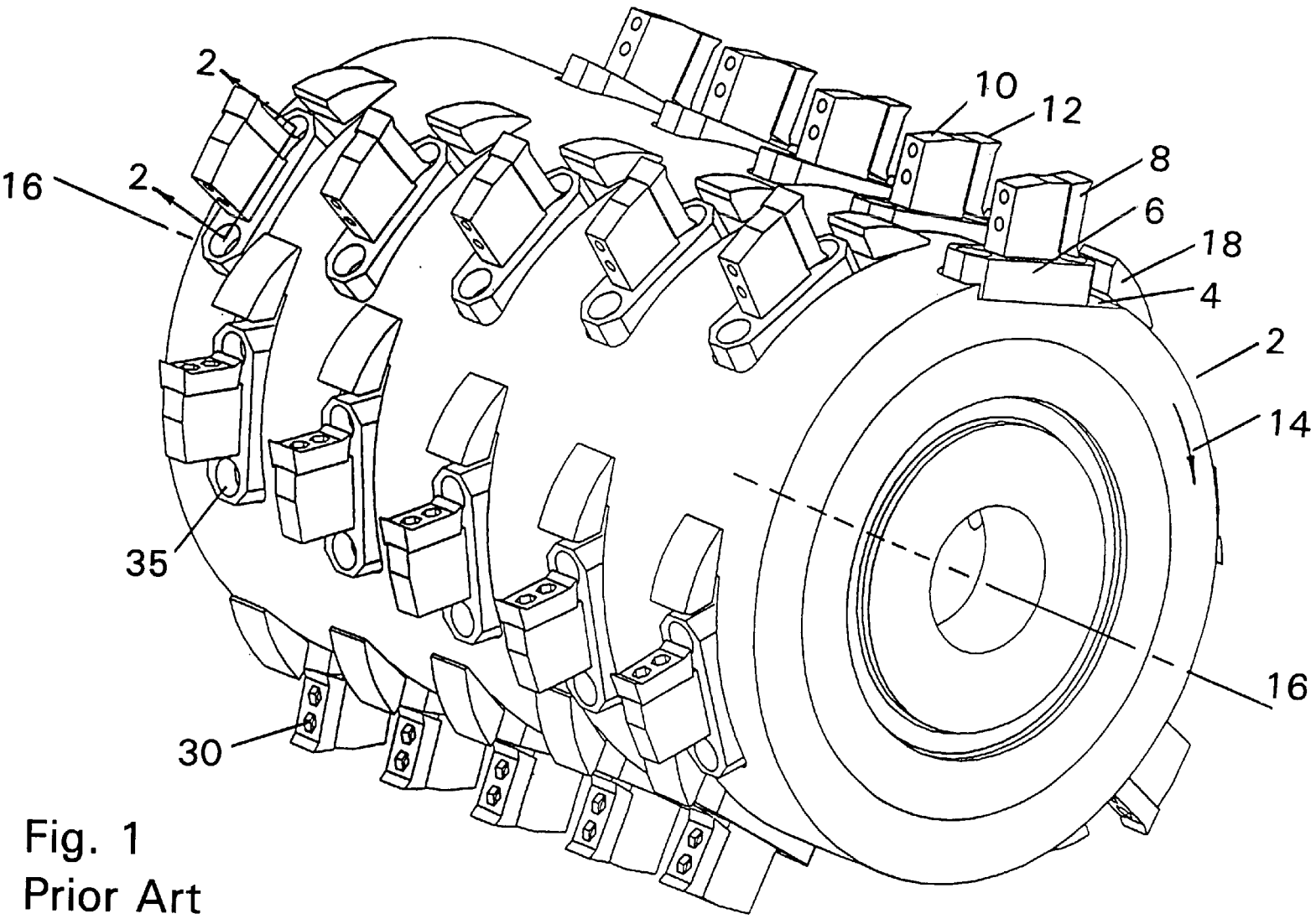
Fig. 1 Prior Art
FIG. 1 is an orthogonal view of a rotor with a plurality of strikers and retainers mounted thereto, showing two types of strikers.

Referring to FIG. 1, a prior art assembly of rotor 2 of a wood comminutor defines striker carrying faces 4 for supporting a retainer bases 6 which supports strikers 8 by way of striker retainers 10 against comminuting forces during comminution with the face 4 and cutting edge 12 of the striker 8 facing in the direction of rotor rotation 14 about rotor axis 16. Projections 18 on the rotor 2, one for each striker 8, direct a work piece (not shown) into the cutting edge 12 of each striker 8 and away from striking the work piece facing side of retainer base 6. The configuration of strikers, striker retainers, and projections shown herein are based on prior art designs, and are therefore not discussed in detail herein.

Figure 2:
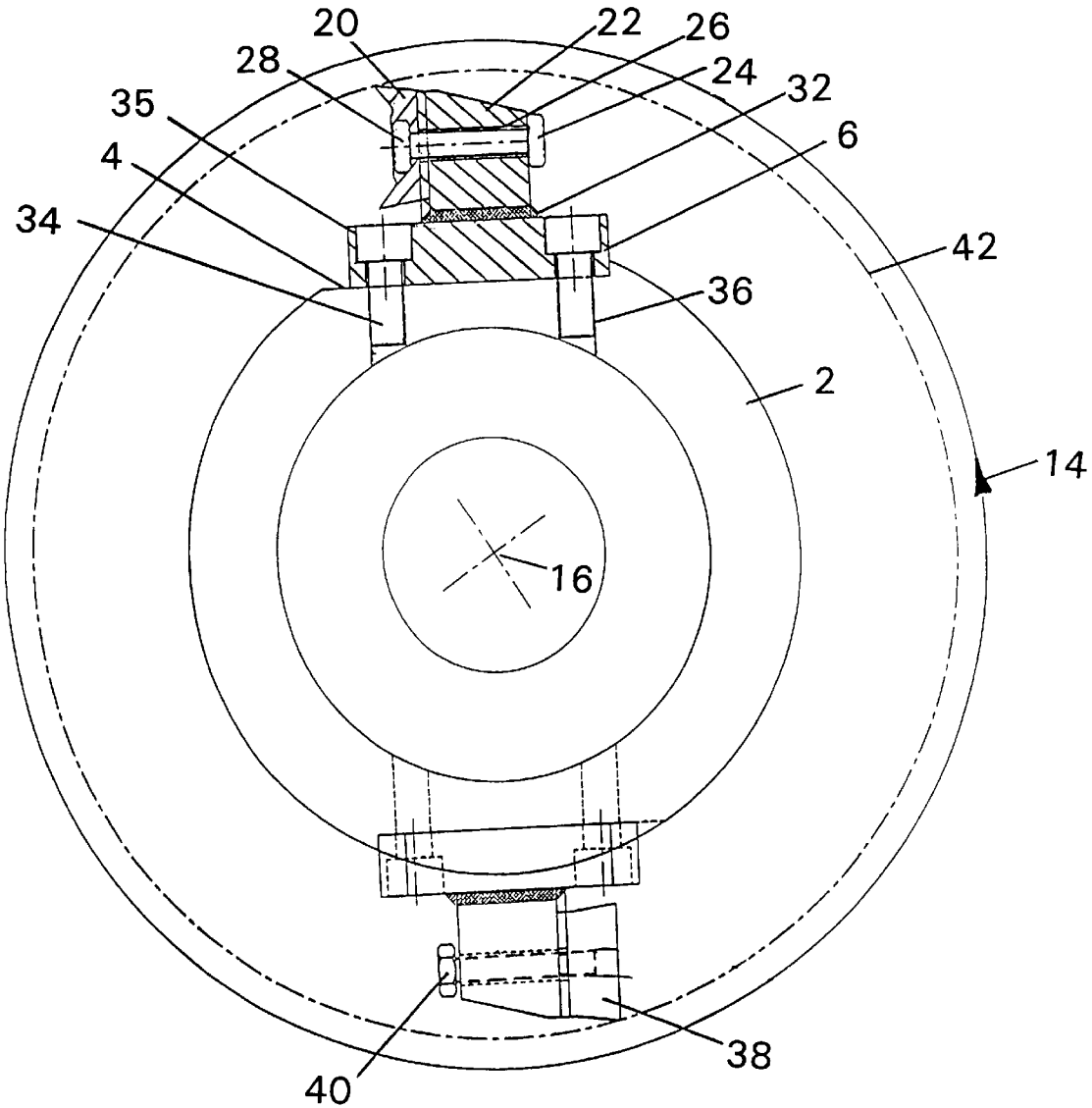
FIG. 2 is a sectional end view of a rotor of the present invention showing two types of strikers attached to the rotors by way of retainers and bases.

Referring to FIG. 2, the cruciform slot and key attachment of a striker 20 to striker retainer 22, of the present invention, is shown. The striker 20 is captively mounted to striker retainer 22 by a single bolt 28 extending through bore 26 to a nut 24 and fixed against rotation by a hex machined opening 30 in striker 20. Striker retainer 22 is captively mounted by a weld joint 32 to retainer base 6, which in turn is captively mounted to rotor 2 at retainer carrying face 4 by two bolts 34 extending through two countersunk bores 35 through retainer base 6 and mating threaded bores 36 in rotor 2.

Also shown in FIG. 2 is a second design of striker 38 which has a blind threaded hole for accepting bolt 40. The arc of striker rotation 42 is shown in FIG. 2.

Figure 3:
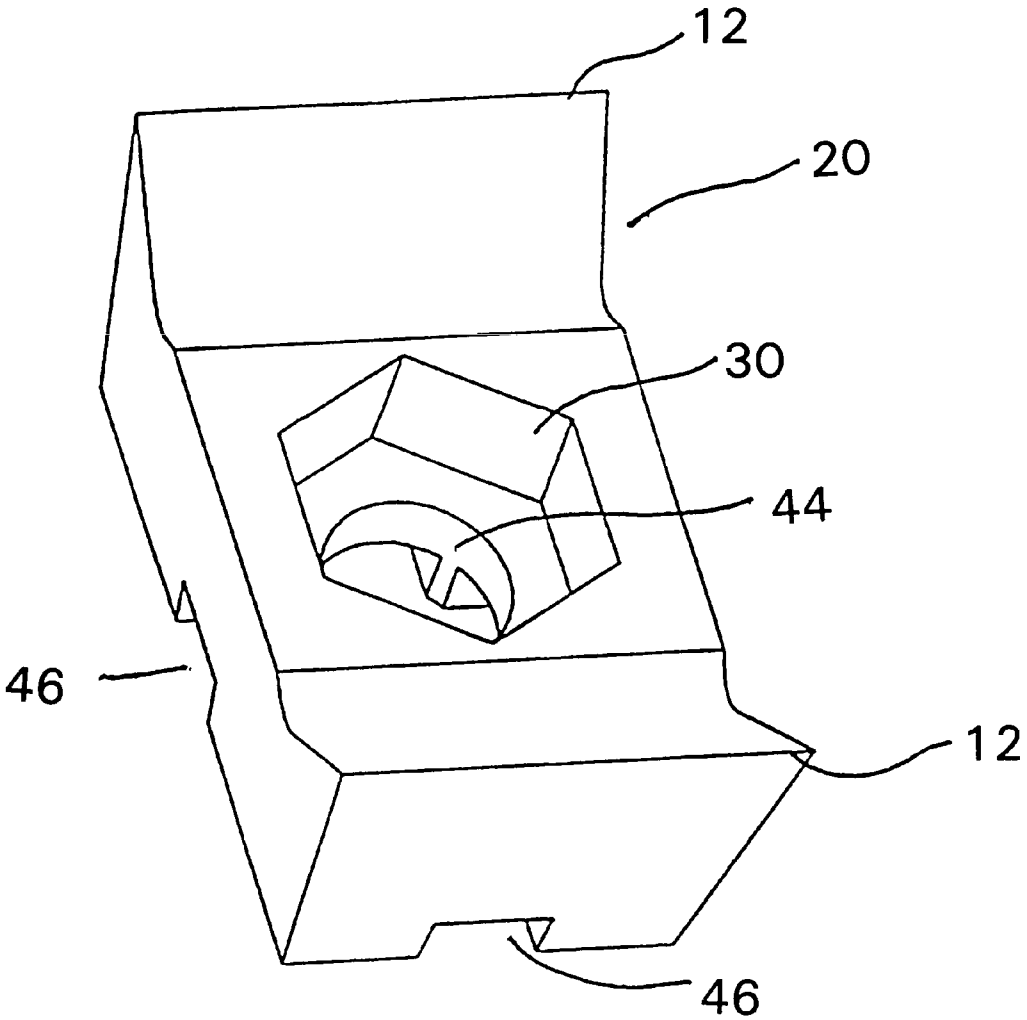
FIG. 3 is a perspective view of a preferred embodiment two edged striker with cruciform key slots, and a single fastener hex opening.
Figure 4:
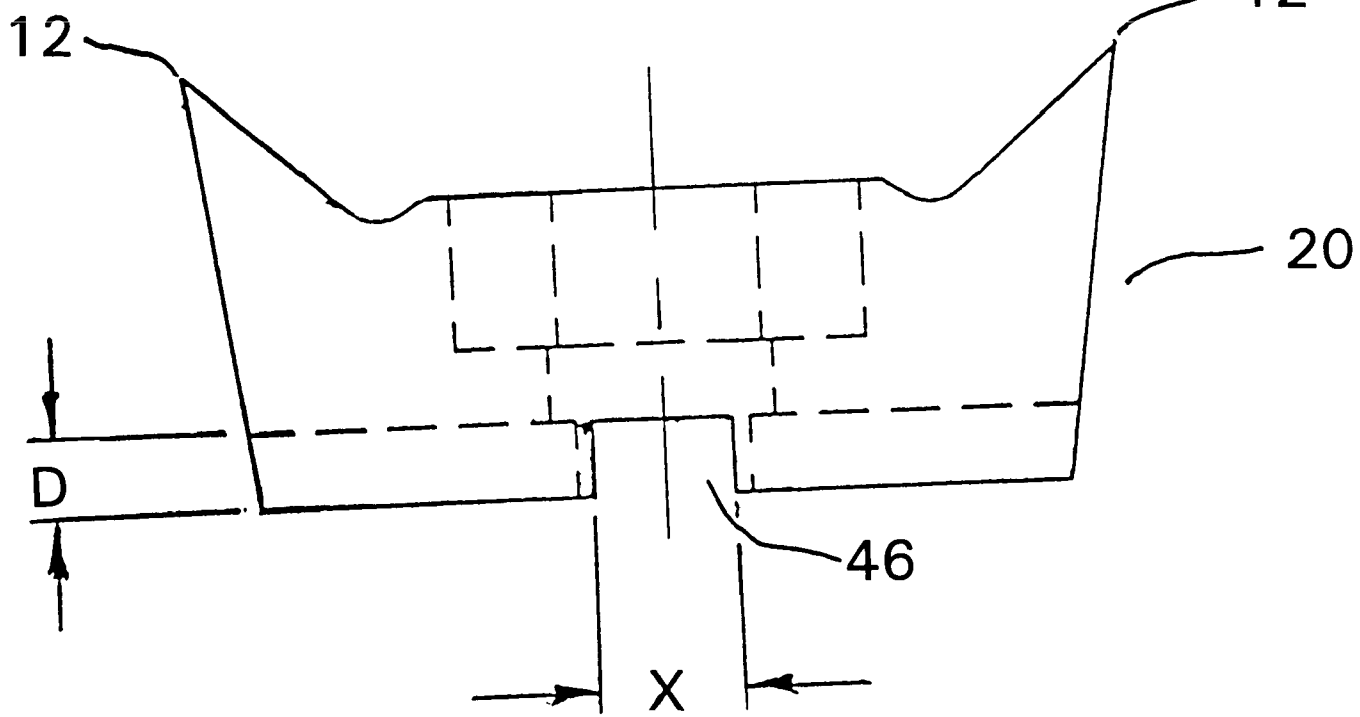
FIG. 4 is a side elevation of the striker of FIG. 2.
Figure 5:
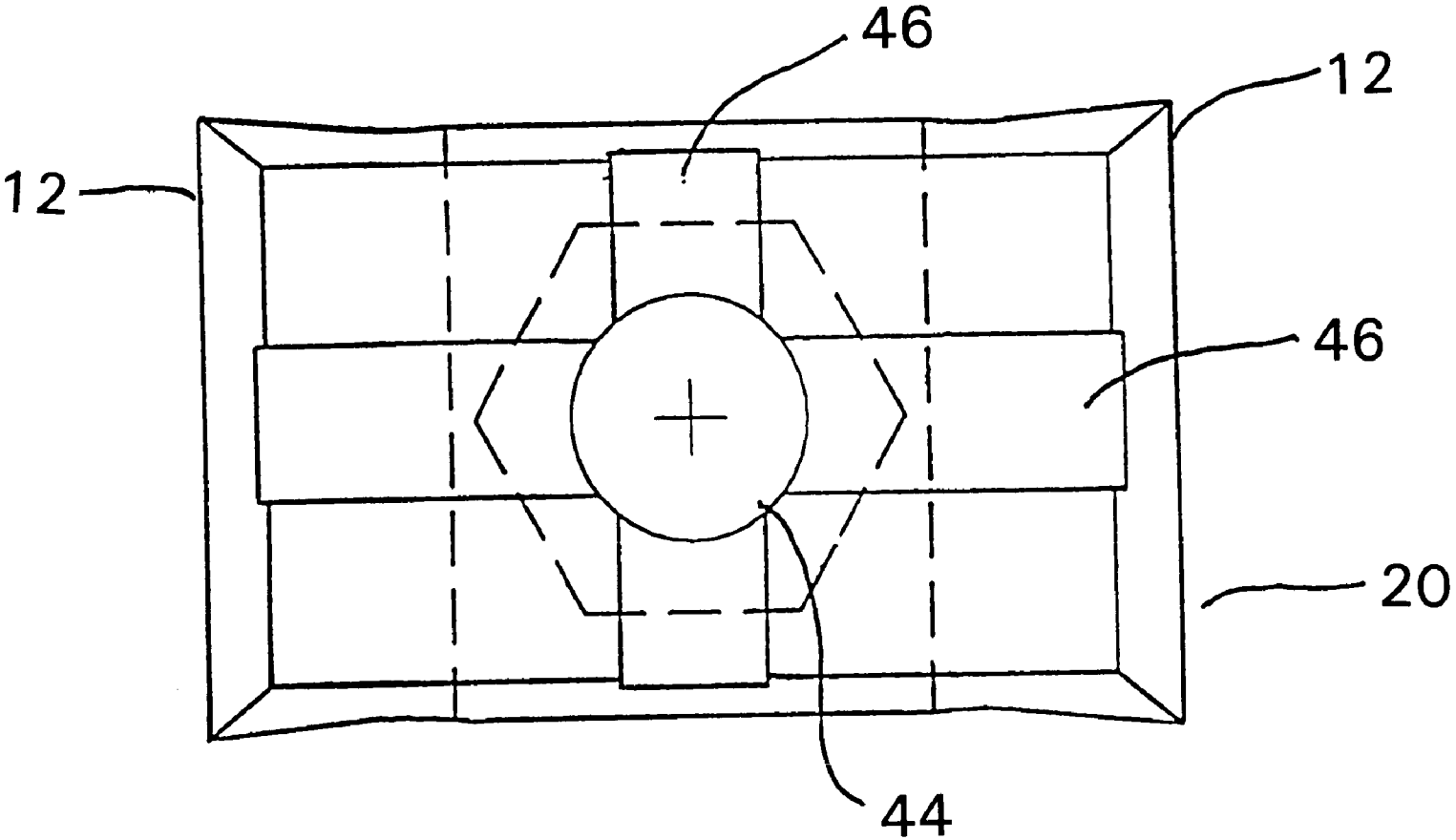
FIG. 5 is a rear view of the striker of FIG. 2 showing the cruciform key slots.

Referring to FIGS. 3, 4 and 5, preferred embodiment two edged striker 20 is shown. Cutting edges 12, hex shaped machined recessed opening 30, bolt clearance bore 44, and slots 46 are shown. Two slots 46 are machined perpendicular to each other and each centrally aligned with a centerline of clearance bore 44. The width X of slots 46 are machined to matingly receive the machined keys 50 of a striker retainer 22 (FIGS. 6 and 7), with a tight clearance fit. A tight clearance fit ensures minimal twisting motion is permitted between the striker and striker retainer. The machined depth D of slots 46 are equal to at least the height H of mating keys 50 shown in FIGS. 6 and 7 to ensure complete engagement of keys 50 within slots 46.

Figure 6:
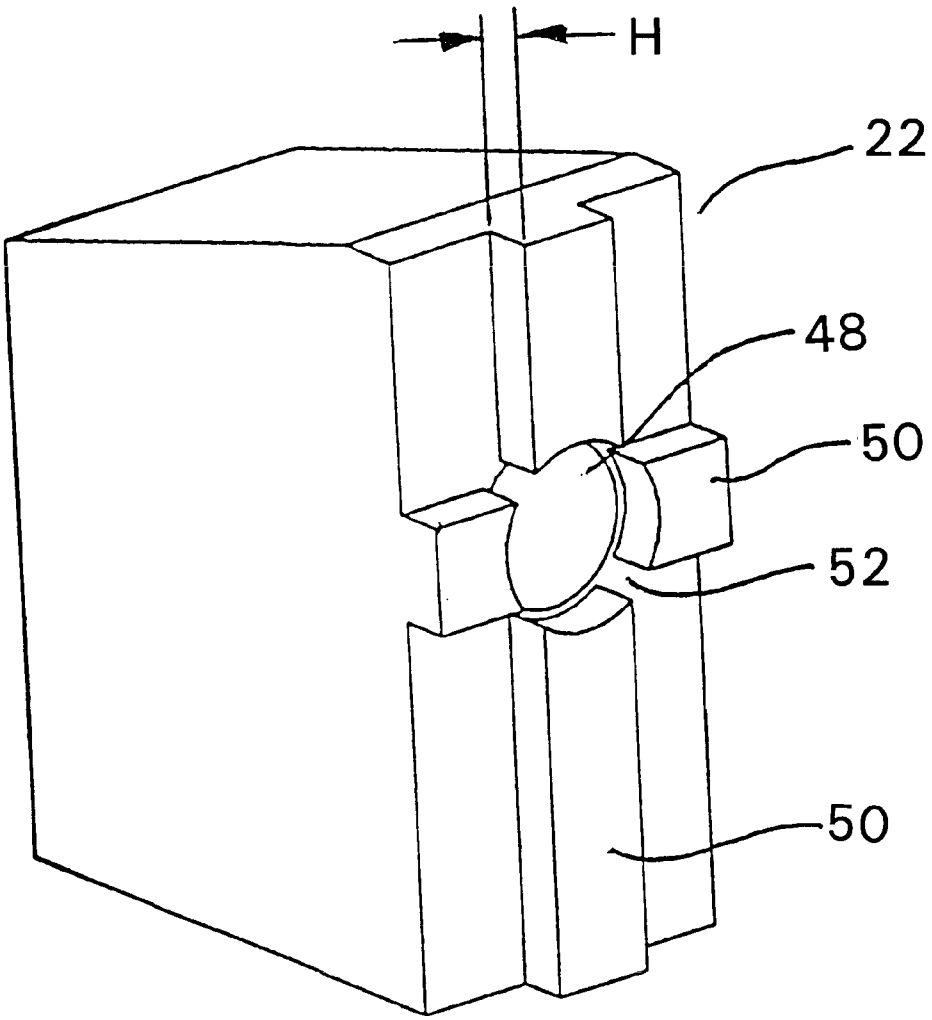
FIG. 6 is a perspective view of a striker retainer according to the present invention with male cruciform keys to engage the cruciform key slots.
Figure 7:
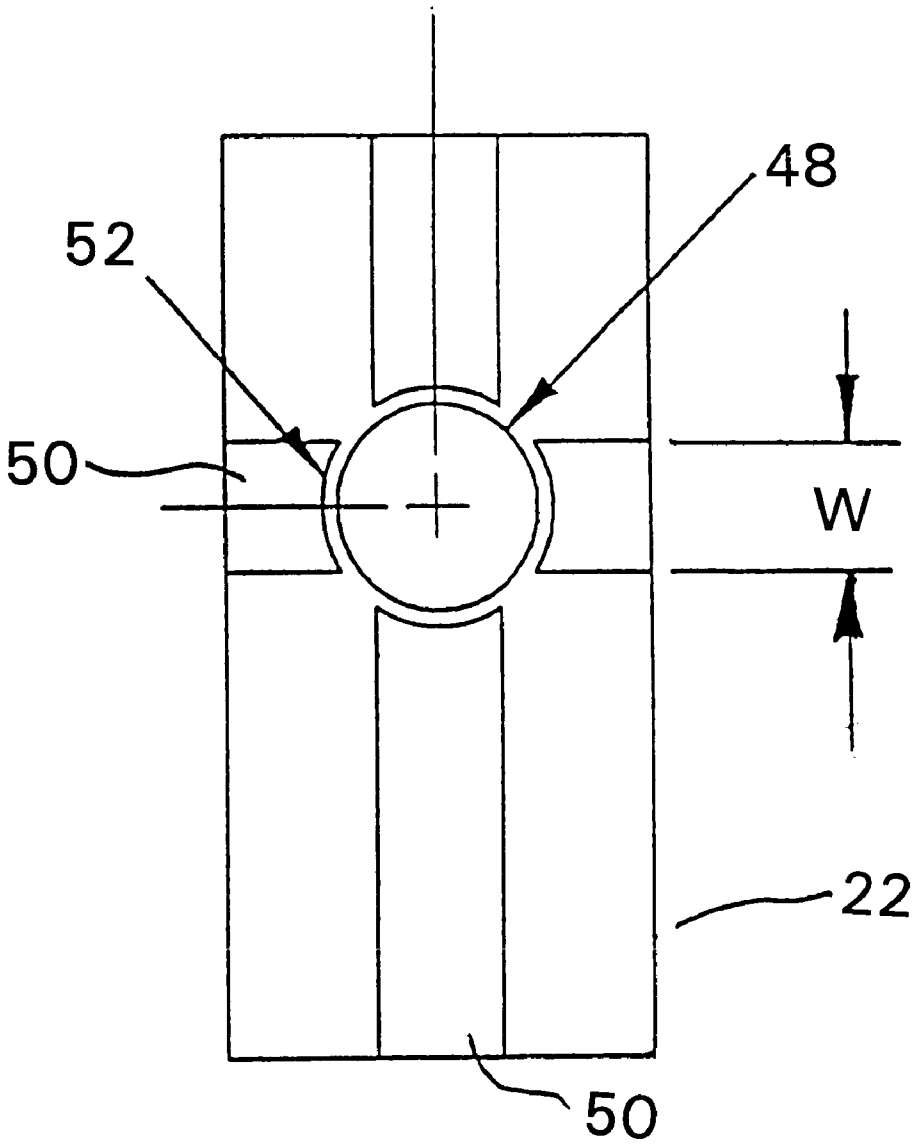
FIG. 7 is a front elevation of the striker retainer of FIG. 6.

Referring to FIGS. 6 and 7, a striker retainer 22 is shown, with the raised machined keys 50, machined to mate in a tight clearance fit with the slots 46 of striker 20. Striker retainers are shaped to have a relatively tall leading face to which the striker is attached, and a relatively short opposed following face, which allows clearance between the work piece in contact with the striker cutting edge and the shorter face, such that only the cutting edge directly contacts the work piece. A relatively larger diameter counterbore 52 than the diameter of bore 48 is machined in central alignment with bore 48 to a counterbore depth which is at least the height H of keys 50. Counterbore 52 eliminates the machining difficulty of squaring the inside corners of keys 50 where the keys 50 intersect bore 48. This ensures mating alignment between keys 50 and slots 46 for the entire height H of keys 50. Key width W is machined on striker retainer 22 for the tight clearance fit with slots 46 discussed herein. Bore 48 is shown vertically off center of striker retainer 22 in FIG. 7, to provide a desired clearance of the bore from the retainer base 6.

Figure 8:
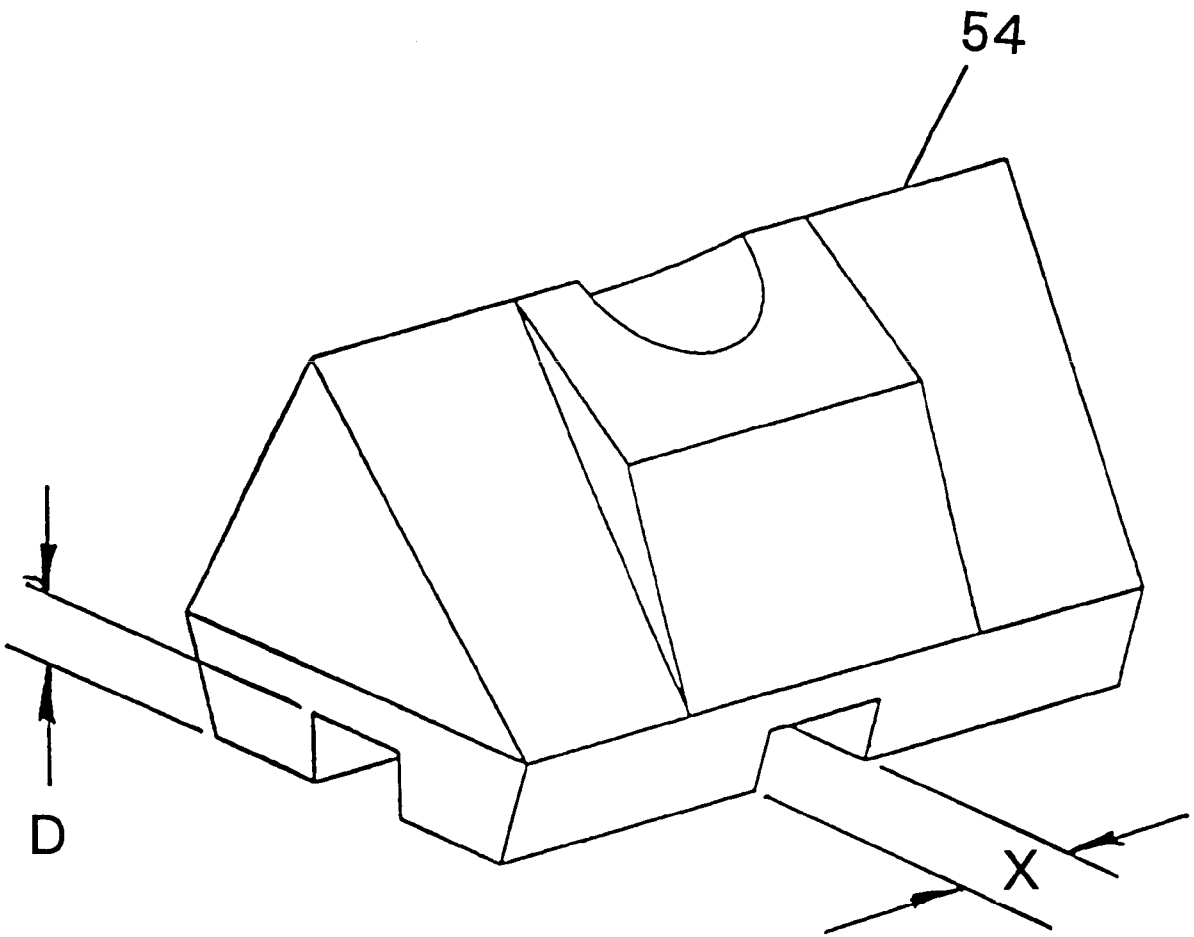
FIG. 8 is an alternative embodiment single tooth striker according to the invention.

FIG. 8 is an alternative embodiment of a striker having a cutting edge 54 rotated 90 degrees compared to cutting edges 12 of FIG. 3, and including the cruciform slots of the present invention.

In use, slots 46 in striker 20 mate with the keys of striker retainer 22 such that motion between the mating faces of striker 20 and striker retainer 22 is minimized and alignment is assured. While connecting the striker 20 to striker retainer 22, the head of a hex bolt 28 is matingly positioned in hex machined opening 30. The bolt 28 connects with nut 24. Bolt 24 extends through clearance bore 44 in striker 20 and through bore 26, to threadably engage with hex nut 24. Torquing hex nut 24 to bolt 28 mechanically fastens striker 20 and striker retainer 22.

When the first of striker 20 cutting edges 12 becomes dull through use, nut 24 is removed, striker 20 is lifted away from striker retainer 22 until the slots 46 and keys 50 no longer engage, and striker 20 is rotated 180 degrees and its slots 46 re-mated to keys 50 of striker retainer 22. Nut 24 and bolt 28 are then rethreaded and torqued to complete the reassembly. If both cutting edges 12 of striker 20 become dull from use, and resharpening or replacement of striker 20 is required, the above steps to remove and reassemble striker 20 are applied, eliminating the rotation step.

It is desirable to rotate a sharp cutting edge 12 into position by loosening, but not totally removing, nut 24 from bolt 28. This prevents loss of either or both nut 24 and bolt 28, and speeds up this maintenance evolution.

The preferred embodiment of the invention includes cruciform shaped, or two (2) perpendicular slots, mating with two (2) perpendicular raised keys. Other forms of slot and key attachment are feasible, including but not limited to a single slot and mating key, more than two slots and mating keys, and slot/key combinations machined transversely. It will be understood that the use of at least one slot and key combination provides a face to face horizontal locking means between the striker and striker retainer which enables use of a single fastener or fastening technique to be applied to positively join the faces of the striker and striker retainer of a comminuting device.

It should also be understood that the items receiving the slot and key may be reversed. In the claimed invention, the striker may therefore have a raised key or keys in place of the female slot(s), and the striker retainer may have a slot or slots in place of the male key(s). The raised keys, if more than one is employed, would then be counterbored as noted herein. Other aspects of the claimed invention would remain similar to those described herein.

Figure 9:
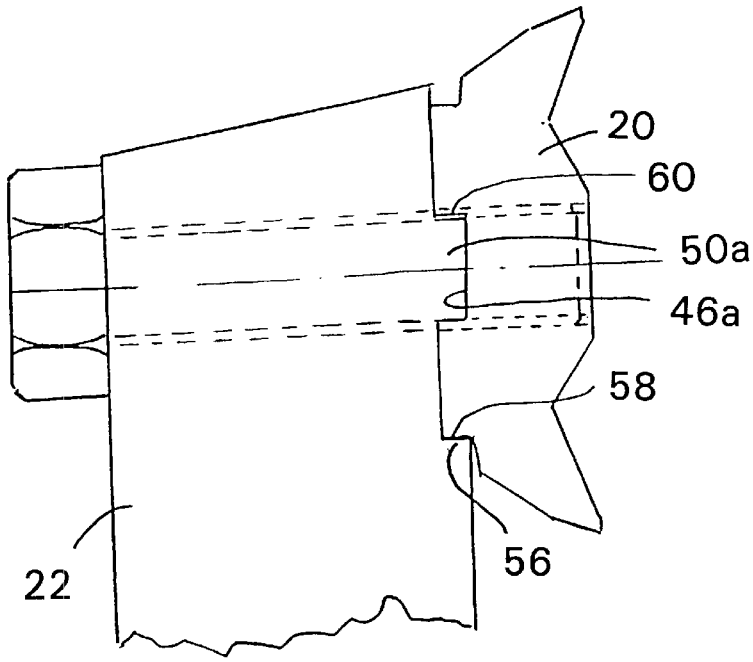
FIG. 9 is an elevation of a further embodiment of striker and striker retainer of the present invention shown assembled and bolted together.
Figure 10:
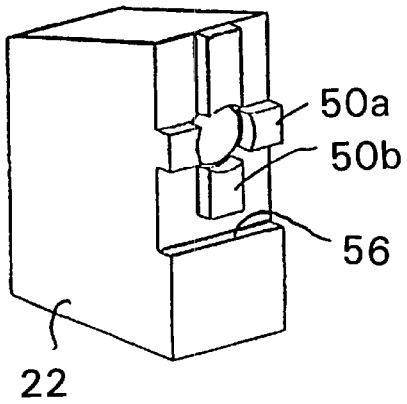
FIG. 10 is a perspective view of the striker retainer shown in FIG. 9.
Figure 11:
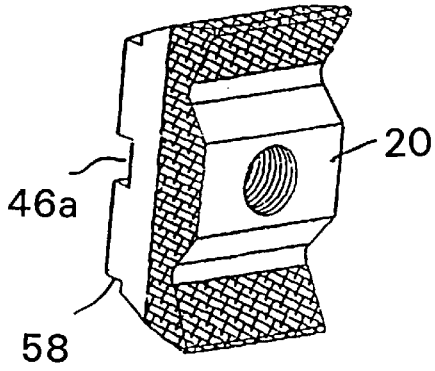
FIG. 11 is a perspective of the striker shown in FIG. 9.

Referring now to FIGS. 9, 10 and 11, an alternative embodiment of striker 20 and striker retainer 22 is shown in which, when assembled together (FIG. 9), an upward facing surface 56 on the retainer 22 provides primary support for the striker 20 by virtue of the engagement of the surface 56 with a corresponding surface 58 machined in the striker 20. This primary support is facilitated by the provision of a clearance 60 (e.g. 0.010 inch) between the machined key 50*a* of the striker retainer 22 and the corresponding slot 46*a* in the striker, this clearance 60 is between the upwardly facing surface of the key 50*a* and the downwardly facing surface of the slot 46*a* (as seen in the orientation of the assembly in FIG. 9).

The key 50*a* and slot 46*a* are designed to provide a secondary support for the striker when wear of he striker 20 sufficient to reduce the clearance 60 to zero has occurred.

To facilitate this embodiment the key 50*b* is foreshortened.

Preferably the striker 20 has carbide surfaces as shown by cross-hatching in FIG. 11.

Other features of this embodiment are similar to the embodiment described with reference to FIGS. 2–7 except for the omission of the hex machined opening 30 and will therefore not be described again here.

REFERENCE NUMERALS

2 rotor
4 retainer carrying face
6 retainer base
8 striker
10 striker retainer
12 striker cutting edge
14 rotor rotation
16 rotor axis
18 projection
20 modified striker
22 modified striker retainer
24 nut
26 bore
28 bolt
30 hex machined opening
32 weld joint
34 bolt
35 countersunk bore
36 threaded bore
38 alternative striker
40 bolt
42 striker arc
44 clearance bore
46, 46*a* slot
48 bore
50, 50*a*, 50*b* raised keys
52 counter bore
54 striker cutting edge
56 upward facing surface
58 corresponding surface
60 clearance
D slot depth
H key height
X slot width
W key width

We claim:

1. A comminuting striker assembly for mounting on a rotor of a comminuting apparatus, comprising:

a striker having first and second opposed faces, the first face defining at least one cutting edge, and the second face defining at least one slot;

a striker retainer having a leading face for attachment to the striker, said leading face defining at least one raised key, and an opposed following face;

a threaded fastener for joining said striker to said striker retainer, whereby the slot of the striker closely mates with the key of the striker retainer.

2. The assembly of claim 1, comprising:

a single bore in the striker retainer, opening to both the leading face and the following face;

the threaded fastener passing through the single bore in the striker retainer and the striker to join the striker to the striker retainer.

3. The assembly of claim 2, comprising:

a hex shaped opening in the first face of the striker;

a clearance through bore through the first and second faces of the striker;

a bolt with a hex head sized to fit matably with the hex shaped opening;

the fastener extending through the bore and threadably engaging the hex nut to mechanically join the striker to the striker retainer.

4. The assembly of claim 2, wherein the at least one slot comprises first and second slots perpendicular to one another centered on the single bore; and the at least one key comprises first and second keys perpendicular to one another to closely engage the first and second slots.

5. The assembly of claim 4, wherein the keys have a transverse width, comprising a counterbore in the retainer having a diameter greater than the width of the keys and a counterbore depth at least as deep as a height of the keys, wherein the counterbore encompasses corners at junctions of the perpendicular keys.

6. A comminuting striker assembly for mounting on a rotor of a comminuting apparatus, comprising:

a striker having first and second opposed faces, the first face defining at least one cutting edge, and the second face defining first and second slots transverse of one other;

a striker retainer having a leading face for attachment to the striker, said leading face defining first and second raised keys, to closely engage said slots;

a single fastening means for joining said striker to said striker retainer, whereby the slots of the striker closely engage the keys of the striker retainer.

7. The assembly of claim 6, comprising:

a single bore through the striker retainer, opening to both the leading face and a following face;

the fastener means comprising a bolt passed through the single bore in the following face, through the striker retainer, to threadably join the striker to the striker retainer.

8. The assembly of claim 6, comprising:

a hex shaped machined opening in the first face of the striker;

a through bore machined through the first and second faces of the striker;

a bolt with a hex head sized to fit matably with the hex shaped machined opening;

the threaded bolt passing through the through bore, and threadably engaging the hex nut, to join the striker to the striker retainer.

9. The assembly of claim 6, comprising a counterbore in the retainer having a diameter greater than the width of the keys, and a depth at least as deep as a height of the keys wherein the counterbore encompasses corners at a junction of the keys.

10. A comminuting striker assembly for mounting on a rotor of a comminuting apparatus, comprising:

a striker having first and second opposed faces, the first face defining at least one cutting edge, and the second face defining at least one raised key;

a striker retainer having a leading face for attachment to the striker, said leading face defining at least one slot;

a threaded fastener for joining said striker to said striker retainer, whereby the key of the striker closely mates with the slot of the striker retainer.

11. The assembly of claim 6, comprising:

a single bore through the striker retainer, opening to both the leading face and a following face; and a fastener means passes through the single bore in the following face, through the striker retainer, to threadably join the striker to the striker retainer.

12. A comminuting striker assembly for mounting on a rotor of a comminuting apparatus, comprising:

a striker having first and second opposed faces, the first face defining at least one cutting edge, and the second face defining first and second slots transverse of one other, the first being parallel to the at least one cutting edge;

a striker retainer having a leading face for attachment to the striker, said leading face defining first and second raised keys, to be received by said slots; wherein the second raised key closely engages the corresponding slot; and the striker retainer defines a striker support surface engaging a cooperating surface on the striker to provide primary support for the striker by virtue of a cooperating surface on the striker and a clearance between the first slot and the raised key received thereby.

* * * * *